United States Patent [19]

Funke, nee Honsel

[11] 3,949,637

[45] Apr. 13, 1976

[54] ONION SLICER

[75] Inventor: Gabi Funke, nee Honsel, Sundern, Germany

[73] Assignee: Gebr. Funke Metallwarenfabrik, Sundern, Germany

[22] Filed: Mar. 21, 1974

[21] Appl. No.: 453,471

[30] Foreign Application Priority Data

Mar. 29, 1973 Germany ..... 2315728

[52] U.S. Cl. ..... 83/570; 83/594; 83/595; 241/169.1; 241/190; 241/243

[51] Int. Cl.[2] ..... B26D 5/14

[58] Field of Search ..... 83/591, 594, 595, 665, 83/566, 569, 570; 241/88.4, 168, 169.1, 190, 199.12, 243, 188 R

[56] References Cited

UNITED STATES PATENTS

| | | | |
|---|---|---|---|
| 369,434 | 9/1887 | Chisolm | 241/88.4 X |
| 963,224 | 7/1910 | Hess | 241/190 X |
| 1,004,641 | 10/1911 | Gearhart | 83/595 |
| 1,455,173 | 5/1923 | Scarborough | 83/595 X |
| 2,001,075 | 5/1935 | Sundstrand | 241/169.1 X |
| 2,507,571 | 5/1950 | Lacout | 241/243 |
| 3,463,406 | 8/1969 | Musgrave | 241/188 R X |
| 3,831,469 | 8/1974 | Vadas | 83/595 X |

*Primary Examiner*—J. M. Meister
*Assistant Examiner*—Fred A. Silverberg
*Attorney, Agent, or Firm*—Neil F. Markva

[57] ABSTRACT

An onion slicer comprises a drum-shaped body composed of a bottom part and a removable upper part. The upper part contains a plurality of fixed radially disposed bars forming a grating, a rotatable cutter shaft, and a plurality of knife blades attached to the shaft and adapted to pass through the gaps between neighboring bars when the shaft is rotated.

10 Claims, 4 Drawing Figures

ONION SLICER

BACKGROUND OF THE INVENTION

This invention relates generally to vegetable slicers, and more specifically to an onion slicer for domestic use or for catering establishments, and has for its object the provision of an appliance which will permit for instance one or more onions to be sliced into pieces of suitable size for a contemplated culinary purpose without causing the user to be inconvenienced by the sharp or biting smell of the cut vegetable.

The onion slicer proposed by the present invention comprises a drum-shaped body composed of a bottom part forming a base and a removable upper part containing fixed radially disposed bars forming a grating, a rotatable cutter shaft, and a plurality of knife blades attached to said cutter shaft and adapted to pass through the gaps between neighboring bars when said shaft is rotated.

In order to use an onion slicer which is thus contrived the user need merely take off the upper part of the drum-shaped body from its bottom part, place the vegetable, such as one or more onions, into the bottom part, replace the upper part and turn the shaft, for instance by means of a crank, once or several times. The knife blades will then cut through the onions and pass through the grating which retains the cut slices so that these can be reentrained and carried against the grating again where they are cut a second and third time as the shaft continues to turn. This action can be repeated as often as required until the onions have been cut to small pieces. The upper part of the drum-shaped body can then be taken off and the sliced vegetable taken or poured out of the bottom part. Since the hollow cylindrical body remains tightly closed during the slicing operation the user is not inconvenienced by watering eyes.

In a specially useful embodiment of the invention the shaft, a crank handle attached to one end of the shaft, and the bars of the grating all form components of the upper part of the appliance. When the upper part is removed it therefore allows unobstructed access to the bottom part forming the base.

It is preferred to dispose the bars of the grating in such a way that the slices will drop by gravity into the base each time they are cut. This enables the slices to be reentrained and recut against the bars of the grating in a different position at each revolution of the knife blades.

With advantage the internal surface of the drum-shaped body may be formed with grooves for the reception of the tips of the knife blades as they sweep around the interior. The cut will then always extend across the entire diameter of a vegetable such as an onion.

It may be found useful to stagger the knife blades on the shaft, or to give them a curved shape or to provide them with two cutting edges for the purpose of improving their slicing action.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
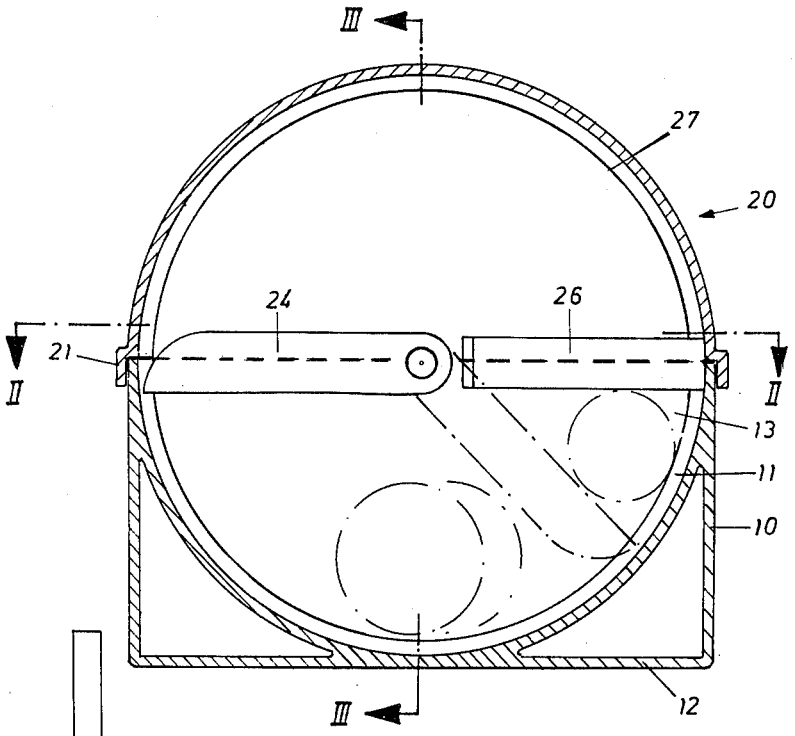
FIG. 1 is an elevational section of an onion slicer according to the invention, the section being taken on the line I—I of FIG. 2.

The drawings show an onion slicer which comprises a bottom part 10 forming a hemicylindrical trough 13 and having a flat underside 12 to permit the slicer to be placed firmly on a supporting surface.

A removable upper part 20 fits on the bottom part 10, and the joint between the two parts is lapped by a flange 21 which creates a seal confining the biting smell of the onions to the inside. The interior of the upper part 20 combines with the hemicylindrical trough 13 in the bottom part 10 to form a completely cylindrical chamber.

At each end of the upper part 20 a bearing 22 is provided for mounting a rotatable cutter shaft 23. A hand crank 25 is attached to, or formed integral with, one of the ends of the cutter shaft 23. The entire length of the cutter shaft is armed with knife blades 24 which extend in radial directions.

The interior of the upper part 20 contains a fixed grating consisting of parallel bars 26. When the hand crank 25 is turned the knife blades 24 pass through the gaps between neighboring bars 26. The slicer is used by placing one or more onions into the trough 13 and then fitting the upper part on the bottom part 10. The hand crank 25 is then turned several times. The onion slices which drop into the bottom part of the trough 13 at each revolution of the knife blades are reentrained by the knife blades 24, pressed against the undersides of the bars and cut to the size required for the contemplated culinary purpose. That is, the length of the knife blades 24 is sufficient to reentrain cut pieces of onion because the points of the blades 24 are close enough to the internal cylindrical wall of trough 13 that even small pieces of onion are carried therealong. The grating must be suitably disposed to ensure that the onion slices drop each time they have been cut. This can be achieved for instance by locating the grating in a horizontal position. As is evident, bars 26 include a generally downwardly facing side against which the onion entrained by blades 24 is held while being cut by said blades 24.

The upper part of the slicer and the bottom part may be produced as plastics moldings. An onion slicer according to the invention can be made in any desired size, for instance it may be sufficiently large to enable several onions to be sliced at the same time. As an alternative to hand operation a motor drive may be provided.

Figure 2:
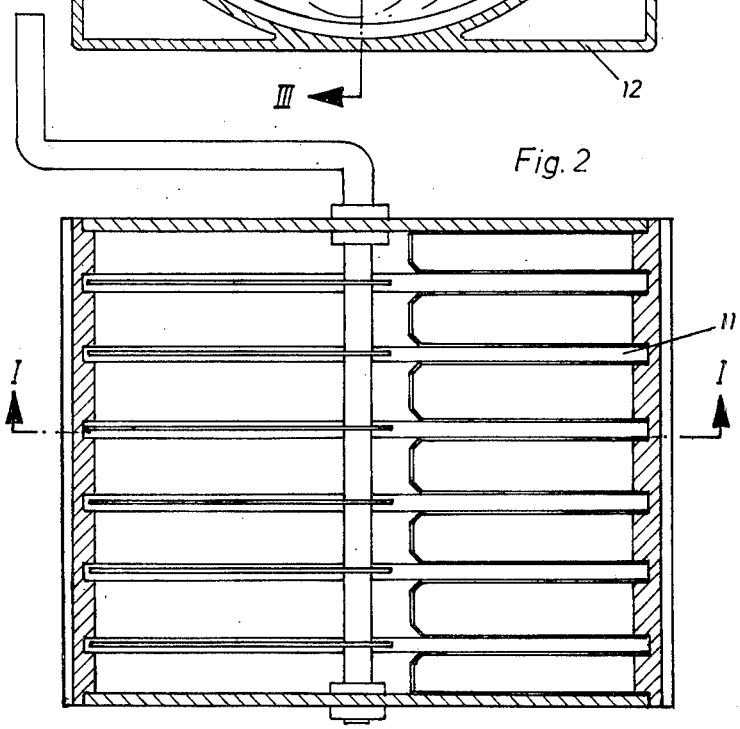
FIG. 2 is a substantially horizontal section taken on the line I—I of FIG. 1.
Figure 3:
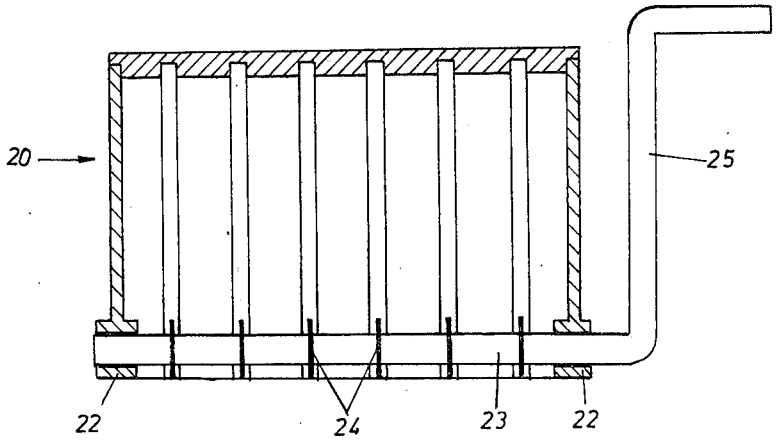
FIG. 3 is a half section taken on the line III—III of FIG. 1.

The internal cylindrical wall of the body may be formed with grooves 11 or 27 which serve for the reception of the tips of the rotating knife blades and are shown in FIGS. 1 and 2.

Figure 4:
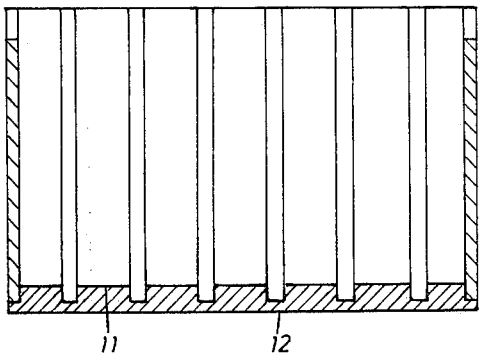
FIG. 4 are perspective illustrations of different embodiments of the knives.
Figure 4:
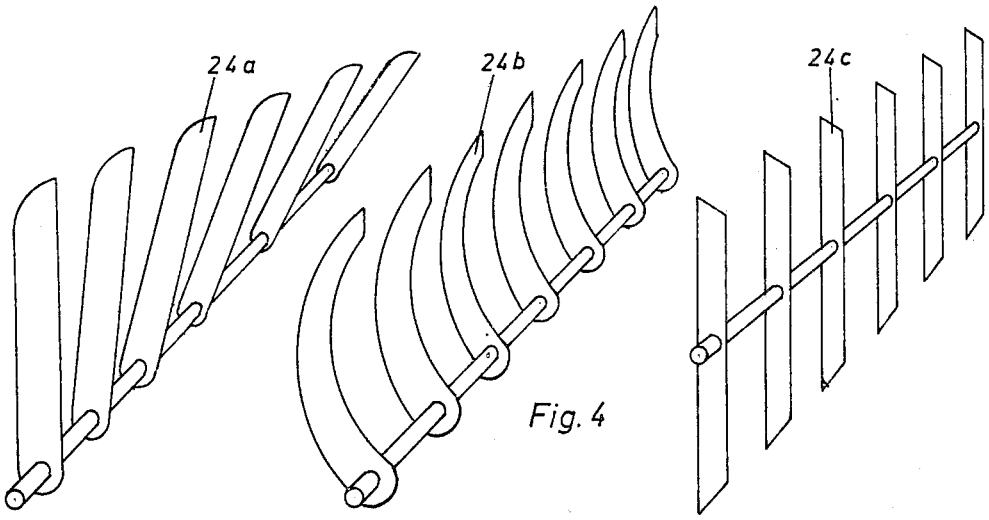

Furthermore, the spacing of the knife blades and the spacing of the bars of the grating may be chosen as may be desired. Finally the shape and arrangement of the knife blades may be varied as shown in the drawings, for example the knife blades may be staggered as at **24*a* in FIG. 4, curved as at 24*b* in FIG. 4, or they may be double-edged blades as at 24*c* in FIG. 4**.

I claim:

1. An onion slicer comprising:
a. a bottom base portion,
b. an upper portion removably disposed on the base portion to form a cutting chamber,
c. said cutting chamber including a cylindrical internal surface having a plurality of grooves,
d. grating means disposed in said upper portion and having laterally displaced gaps therein,
e. a rotatable cutter shaft extending through the cutting chamber, and
f. cutting means disposed on the cutter shaft and having a plurality of knife blades adapted to pass through the gaps of the grating means when the cutter shaft is rotated,
g. said knife blades having a length sufficient for the tips of the blades to extend into said grooves.

2. A slicer as defined in claim 1 wherein
said grating means includes a plurality of bars which are disposed in the upper portion.

3. A slicer as defined in claim 2 wherein
the bars are radially disposed and fixedly located in the upper portion and the cutter shaft is permanently attached to the upper portion.

4. A slicer as defined in claim 2 wherein
the plurality of bars are horizontally fixed in the upper portion.

5. A slicer as defined in claim 1 wherein
the knife blades are curved.

6. A slicer as defined in claim 1 wherein
the knife blades are staggered with respect to each other along the circumference of the cutter shaft.

7. A slicer as defined in claim 1 wherein
the knife blades are double edged.

8. A slicer as defined in claim 1 wherein
the cutter shaft includes a crank handle attached to the end thereof and located outside the base and upper portions which form the cutting chamber.

9. A slicer as defined in claim 1 wherein
flange means form a seal between the base and upper portions to maintain odors within the cutting chamber.

10. A slicer as defined in claim 2 wherein
said bars have a generally downwardly facing side against which the onion entrained by the rotating knife blades is held while being cut by said blades.

* * * * *